US010519750B2

(12) United States Patent
Davis et al.

(10) Patent No.: US 10,519,750 B2
(45) Date of Patent: Dec. 31, 2019

(54) RECLOSABLE MULTI-ZONE ISOLATION USING A PULL-FORCE LOCK MECHANISM

(71) Applicant: Halliburton Energy Services, Inc., Houston, TX (US)

(72) Inventors: Jason Earl Davis, Columbia, SC (US); William David Henderson, Tioga, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/524,937

(22) PCT Filed: Mar. 7, 2016

(86) PCT No.: PCT/US2016/021200

§ 371 (c)(1),
(2) Date: May 5, 2017

(87) PCT Pub. No.: WO2017/155504

PCT Pub. Date: Sep. 14, 2017

(65) Prior Publication Data

US 2018/0363417 A1 Dec. 20, 2018

(51) Int. Cl.
*E21B 34/14* (2006.01)
*E21B 23/04* (2006.01)
(Continued)

(52) U.S. Cl.
CPC ..... *E21B 34/14* (2013.01); *E21B 23/04* (2013.01); *E21B 43/14* (2013.01); *E21B 2034/007* (2013.01)

(58) Field of Classification Search
CPC ..... E21B 34/14; E21B 43/14; E21B 23/04; E21B 2034/007
See application file for complete search history.

(56) References Cited

U.S. PATENT DOCUMENTS 6,230,811 B1 5/2001 Ringgenberg et al.
6,983,795 B2 1/2006 Zuklic et al.
(Continued)

FOREIGN PATENT DOCUMENTS

WO WO 2007/131134 A2 11/2007
WO WO 2015/119727 A1 8/2015

OTHER PUBLICATIONS

International Search Report and The Written Opinion of the International Search Authority, or the Declaration, dated Dec. 5, 2016, PCT/US2016/021196, 17 pages, ISA/KR.
(Continued)

*Primary Examiner* — Brad Harcourt

(57) ABSTRACT

A reclosable multi-zone isolation tool including a mandrel assembly with a pull-force lock feature. The tool includes an outer and inner tubular having an annular flow path defined there between, and a central flow path defined by the inner tubular. The annular flow path is in fluid communication with the first zone, while the central flow path is in fluid communication with the second zone. A sleeve is positioned in the annular flow path and moveable between an open and closed position. A mandrel assembly is slidingly positioned within the inner tubular and coupled to the sleeve to actuate the sleeve between the open and closed position only when a push force is applied. If a pull force is applied, the mandrel assembly "locks out," thereby preventing movement of the sleeve.

14 Claims, 8 Drawing Sheets

(51) Int. Cl.
*E21B 43/14* (2006.01)
*E21B 34/00* (2006.01)

(56) References Cited

U.S. PATENT DOCUMENTS

| | | | | |
|---|---|---|---|---|
| 7,210,534 | B2 | 5/2007 | Hayter et al. | |
| 8,522,877 | B2 | 9/2013 | Chambers et al. | |
| 8,757,275 | B2 | 6/2014 | Scott et al. | |
| 2003/0019634 | A1 | 1/2003 | Henderson et al. | |
| 2007/0119598 | A1 | 5/2007 | Turner et al. | |
| 2011/0209873 | A1 | 9/2011 | Stout | |
| 2014/0020912 | A1 | 1/2014 | Scott et al. | |
| 2015/0060076 | A1* | 3/2015 | Campbell | E21B 34/14 166/308.1 |
| 2015/0218906 | A1 | 8/2015 | Clem et al. | |
| 2015/0330184 | A1 | 11/2015 | Ringgenberg | |

OTHER PUBLICATIONS

International Search Report and the Written Opinion of the International Search Authority, or the Declaration, dated Nov. 30, 2016, PCT/US2016/021200, 16 pages, ISA/KR.

* cited by examiner

RECLOSABLE MULTI-ZONE ISOLATION USING A PULL-FORCE LOCK MECHANISM

PRIORITY

The present application is a U.S. National Stage patent application of International Patent Application No. PCT/US2016/021200, filed on Mar. 7, 2016, the benefit of which is claimed and the disclosure of which is incorporated herein by reference in its entirety.

FIELD OF THE DISCLOSURE

The present disclosure relates generally to subterranean wellbore operations and, more specifically, to reclosable multi-zone isolation tools utilizing a pull-force lock mechanism.

BACKGROUND

It is common to encounter hydrocarbon wells that traverse more than one separate subterranean hydrocarbon bearing zone. In such wells, the separate zones may have similar or different characteristics. For example, the separate zones may have significantly different formation pressures. Even with the different pressures regimes, it may nonetheless be desirable to complete each of the zones prior to producing the well. In such cases, it may be desirable to isolate certain of the zones from other zones after completion.

For example, when multiple productive zones that have significantly different formation pressures are completed in a single well, hydrocarbons from a high pressure zone may migrate to a lower pressure zone during production. It has been found, however, that this migration of hydrocarbons from one zone to another may decrease the ultimate recovery from the well. One way to overcome this fluid loss from a high pressure zone into a lower pressure zone during production and to maximize the ultimate recovery from the well is to initially produce only the high pressure zone and delay production from the lower pressure zone. Once the formation pressure of the high pressure zone has decreased to that of the lower pressure zone, the two zones can be produced together without any loss of reserves. It has been found, however, that from an economic perspective, delaying production from the lower pressure zone while only producing from the high pressure zone may be undesirable.

DESCRIPTION OF ILLUSTRATIVE EMBODIMENTS

Illustrative embodiments and related methods of the present disclosure are described below as they might be employed in reclosable multi-zone isolation apparatuses that employ a pull-force lock mechanism. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

As described herein, illustrative embodiments and methods of the present disclosure are directed to reclosable multi-zone isolation tools having a mandrel assembly with a pull-force lock feature. In general, the tool includes an outer and inner tubular having an annular flow path defined there between, and a central flow path defined by the inner tubular. The annular flow path is in fluid communication with an upper zone, while the central flow path is in fluid communication with a lower zone. A sleeve is positioned in the annular flow path and axially moveable between an open and closed position. A mandrel assembly is slidingly positioned within the inner tubular and coupled to the sleeve to thereby actuate the sleeve between an open and closed position only when a push force is applied. The mandrel assembly includes an upper mandrel component and a lower mandrel component. If a push force is applied to either the upper or lower mandrel components, the sleeve may be actuated. A "push force" is defined herein as any force that urges one component to move toward another component. However, if a pull force is applied to either the upper or lower mandrel component, the mandrel assembly "locks out," thereby preventing movement of the sleeve. A "pull force" is defined herein as any force acting on the upper or lower mandrel components which urges one component away from the other.

Using the pull force lockout feature of the present disclosure, any differential pressure between the upper annulus and the inner string will only function the sleeve in one direction (for example, the open position). Therefore, during the well life, if the annulus pressure (upper zone) exceeds the inner string pressure (lower zone), the tool will not close itself. Rather, it requires mechanical intervention to close. Accordingly, by preventing unintentional reclosing of the sleeve, a more reliable isolation tool is provided.

Figure 1:
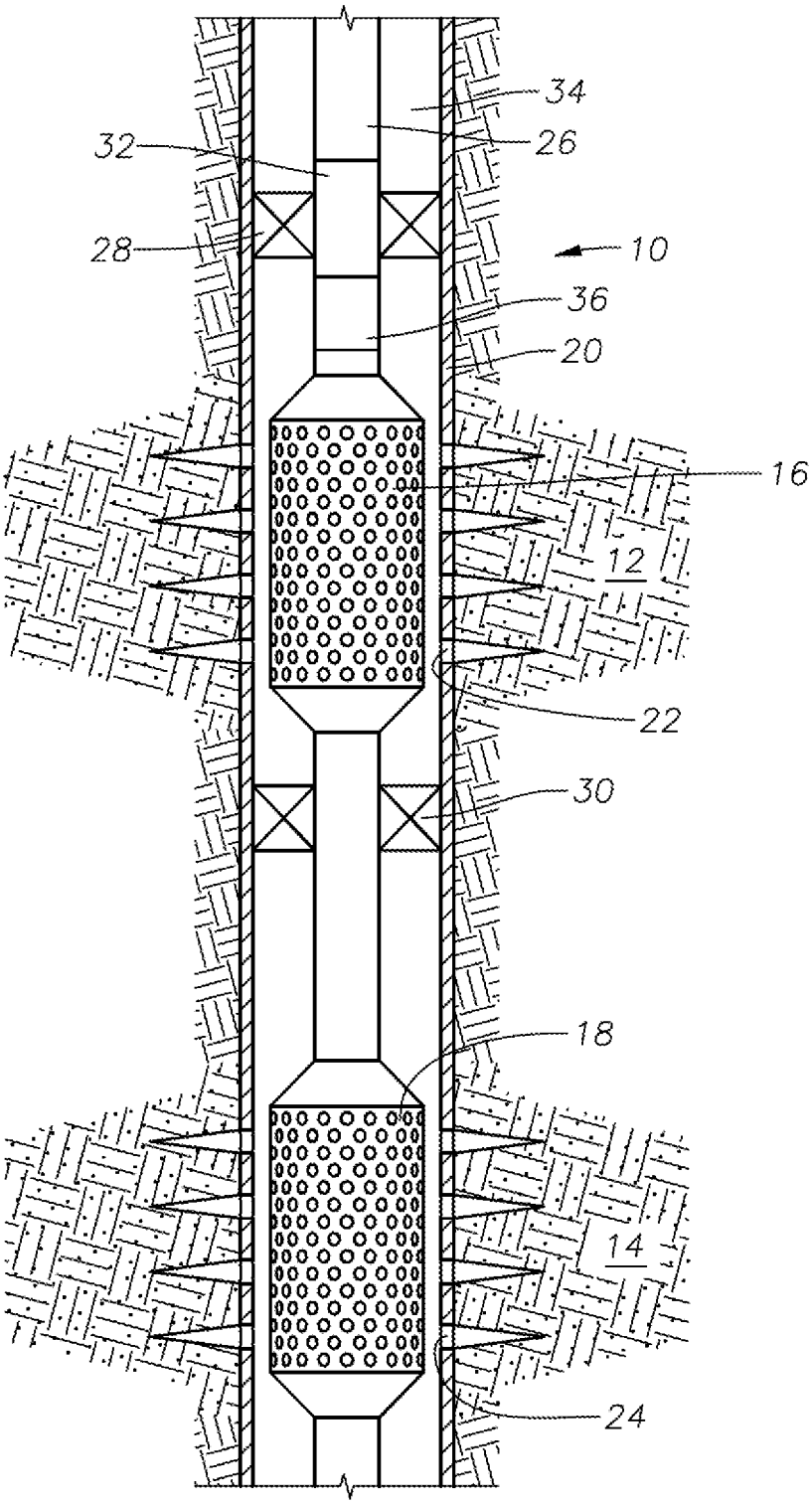
FIG. 1 shows a multi zone isolation apparatus/tool positioned along a cased wellbore, according to certain illustrative embodiments of the present disclosure.

Referring initially to FIG. 1, an illustrative multi zone isolation apparatus/tool of the present disclosure is disposed within a cased wellbore that is generally designated 10. Wellbore 10 is illustrated intersecting two separate hydrocarbon bearing zones, upper zone 12 and lower zone 14. For purposes of description, only two zones are shown but it is understood that the present disclosure has application to isolate any number of zones within a well. As mentioned, while wellbore 10 is illustrated as a vertical cased well with two producing zones, illustrative embodiments of the present disclosure are applicable to horizontal and inclined wellbores with more than two producing zones and in uncased wells.

A completion string disposed within wellbore 10 includes upper and lower sand screen assemblies 16, 18 that are located proximate to zones 12, 14, respectively. Wellbore 10 includes a casing string 20 that has been perforated at locations 22, 24 to provide fluid flow paths into casing 20 from zones 12, 14, respectively. The completion string includes production tubing 26, packers 28, 30 and a crossover sub 32 to enable fluid flow between the interior of the completion string and annulus 34.

The completion string also includes multi zone isolation tool 36, according to certain illustrative embodiments of the present disclosure. As explained in greater detail below, tool 36 functions to connect lower sand screen assembly 18 and production tubing 26 via a first flow path. Tool 36 also functions to selectively isolate and connect upper sand screen assembly 16 to annulus 34 via a second flow path. Thus, tool 36 selectively isolates zone 12 and zone 14 and allows zones 12, 14 to be independently produced.

Referring next to FIGS. 2A-2D, therein is depicted a multi zone isolation tool according to certain illustrative embodiments of the present disclosure, generally designated 100. Tool 100 includes a substantially tubular outer housing assembly 102 that is formed from a plurality of housing members that are securably and sealingly coupled together by threading, set screws or similar technique. In certain illustrative embodiments, housing assembly 102 includes an upper housing member 104, a first upper intermediate housing member 106, a second upper intermediate housing member 108 having a housing extension 110, a housing coupling 112, a sleeve housing member 114 that forms a substantially annular pocket 116 with housing extension 110, a lower intermediate housing member 118, a housing coupling 120 and a lower housing member 122. As will be understood by those ordinarily skilled in the art having the benefit of this disclosure, although a particular arrangement of housing members is depicted and described, other arrangements of housing members are possible and are considered within the scope of the present disclosure.

Figure 2A:
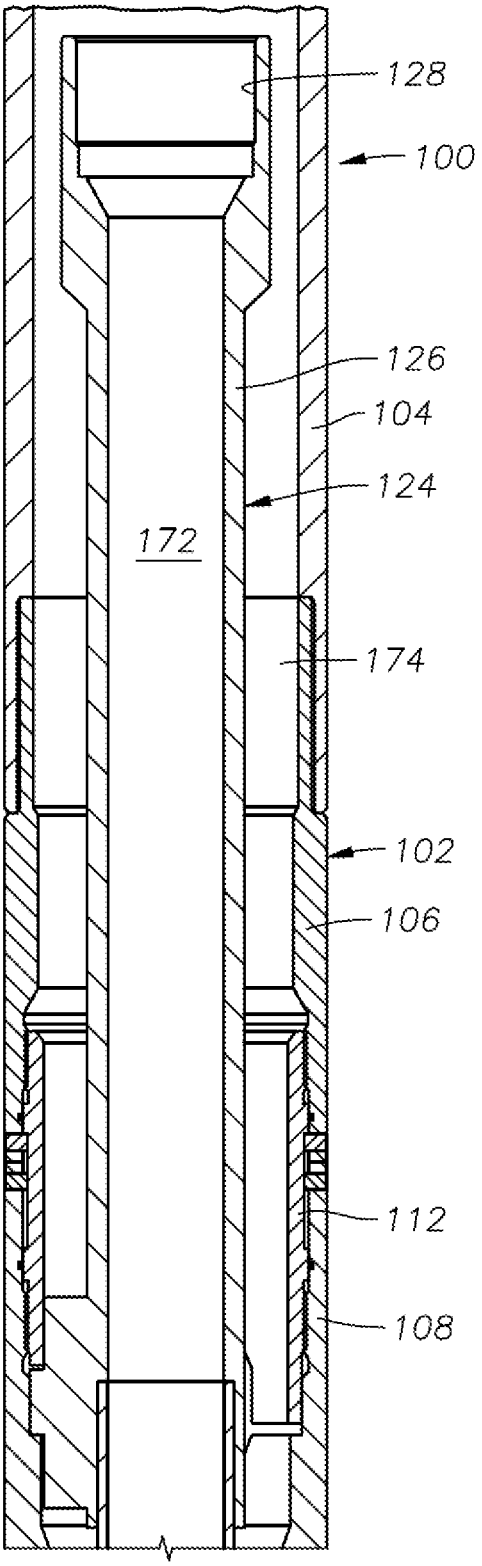
FIGS. 2A-2F show various views of a multi-zone isolation tool in various sleeve positions, according to certain illustrative embodiments of the present disclosure.
Figure 2B:
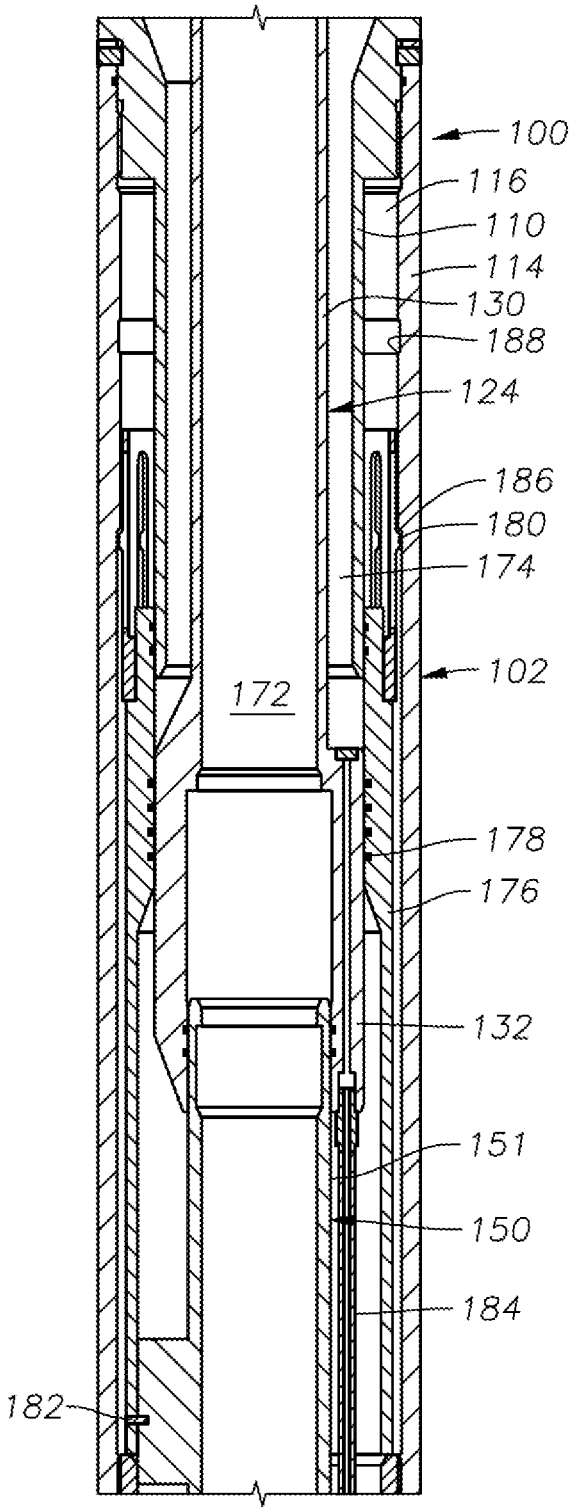
Figure 2C:
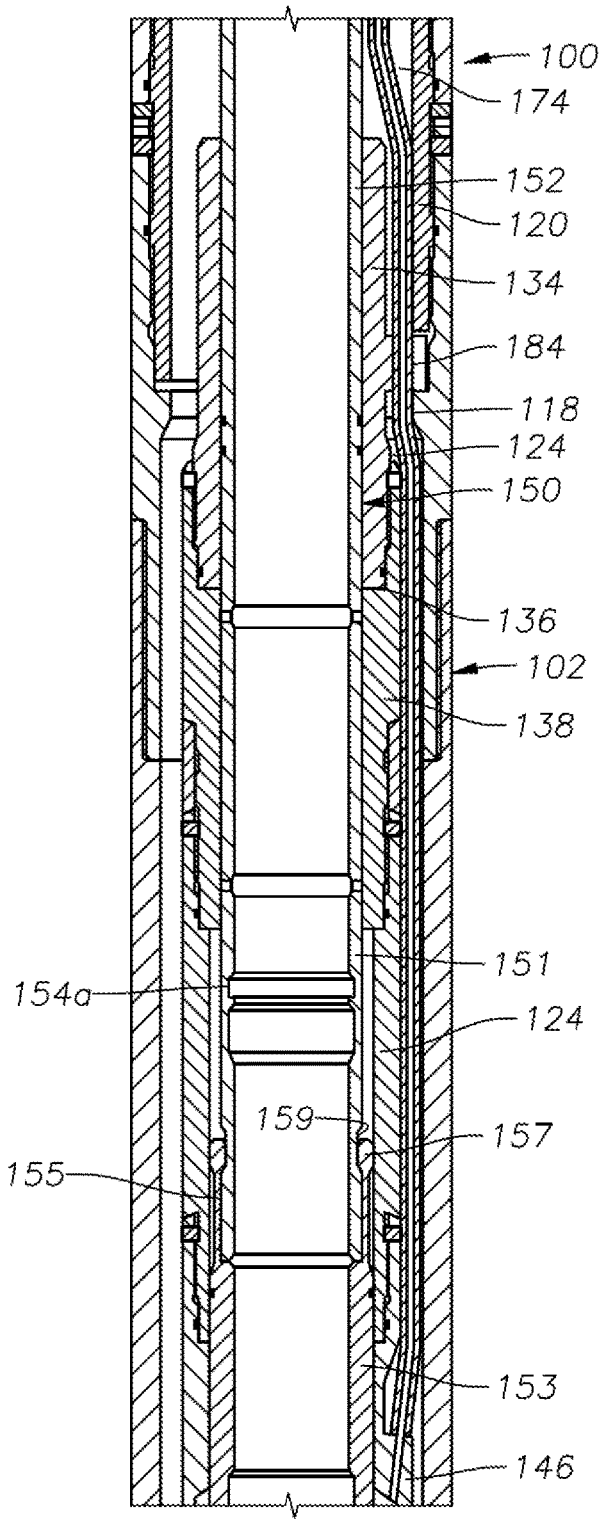
Figure 2D:
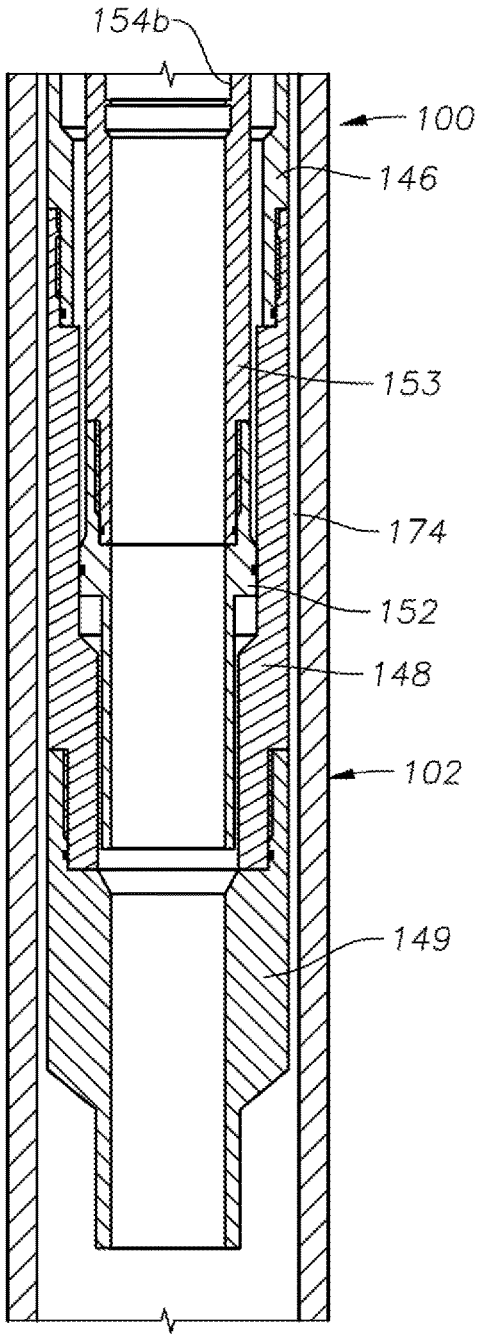

Disposed within housing assembly 102 is an inner tubular assembly 124 that is formed from a plurality of tubular members that are securably and sealingly coupled together by threading, set screws or similar technique. In the illustrated embodiment, tubular assembly 124 includes an upper tubular member 126 having a polished bore receptacle 128, a first upper intermediate tubular member 130 having a radially expanded region 132, a second upper intermediate tubular member 134 having a lower shoulder 136, a first intermediate tubular member 138, a second intermediate tubular member 140, a first lower intermediate tubular member 142 having a profile 144, a second lower intermediate tubular member 146, a third lower tubular member 148, and a fourth lower tubular member 149. An intermediate lower mandrel 152 engages the lower end of mandrel component 153 as shown in FIG. 2D. As mentioned above, those same ordinarily skilled persons will understand that, although a particular arrangement of tubular members is depicted and described, other arrangements of tubular members are possible and are considered within the scope of the present disclosure. For example, in certain embodiments, the same or other components may jointly make up the inner or outer tubular assemblies.

Slidably disposed within tubular assembly 124 is a mandrel assembly 150 that is formed by an upper mandrel component 151 and a lower mandrel component 153. As will be described in more detail below, mandrel assembly 150 is coupled to sleeve 176 via pin 182 to thereby shift sleeve 176 between the open and closed positions. Upper mandrel component 151 slidingly engages lower mandrel component 153. In the illustrated embodiment, mandrel assembly 150 includes profiles 154*a,b* which may be utilized to mechanically shift mandrel assembly 150 using an intervention tool. Together, tubular assembly 124 and mandrel 150 define a central flow path 172 that extends between the upper and lower ends of tool 100. As previously described with reference to FIG. 1, central flow path 172 is in fluid communication with lower sand screen assembly 18 and therefore lower zone 14.

Together, housing assembly 102 and tubular assembly 124 define a substantially annular flow path 174. As previously described with reference to FIG. 1, annular flow path 174 is in fluid communication with upper sand screen assembly 16 and therefore upper zone 12. Disposed within annular flow path 174 is a sleeve 176 that has a plurality of seals 178 disposed on the inner surface thereof. Sleeve 176 is axially moveable between an open and closed positioned (FIG. 2B shows the closed position whereby flow path 174 does not allow fluid communication). In certain illustrative embodiments, sleeve 176 is threadably coupled to a collet assembly 180. Near its lower end, sleeve 176 is securably coupled to mandrel 150 via a threaded connector held in position by a pin 182 that extends through one of three radially expanded sections of mandrel 150 (only one being visible in the figures). Each of the radially expanded sections extends approximately thirty degrees in the circumferential direction such that the flow of fluid through annular flow path 174 is not prevented or substantially obstructed by the radially expanded sections. Also disposed within annular flow path 174 is an equalization pathway depicted as control line 184 that extends between tubular member 130 and tubular member 146.

As previously described, mandrel assembly 150 includes upper mandrel component 151 and lower mandrel component 153. Mandrel assembly 150 is operable to move if a push force is applied to upper mandrel component 151 or lower mandrel component 153. However, once sleeve 176 is in the open position, if a pull force is applied to lower mandrel component 153, a pull force mechanism will lock out mandrel assembly 150 from further movement. The pull force on lower mandrel component 153 may often be caused by high annulus pressure (in annular flow path 174) relative to the pressure in central flow path 172. In such cases, the pressure differential may apply a pulling force to lower mandrel component 153; however, the lock out feature of the present disclosure prevents such unwanted movement.

The operation of tool 100 will now be described with reference to FIGS. 2A-2F. Tool 100 is initially run into the wellbore as part of the completion string with housing assembly 102 preferably forming a portion of the tubular string that extends to the surface. The completion string is then positioned at the desired location, such as that depicted in FIG. 1. Initially, tool 100 is in its closed position as depicted in FIGS. 2A-2D wherein sleeve 176 is in its lower position with seals 178 engaging an outer sealing surface of inner tubular member 130 such that fluid flow through annular flow path 174 is prevented. In this configuration, treatment or other operations requiring fluid flow and pressure fluctuations downhole of tool 100 are performed through central flow path 172. Even though pressure fluctuations are occurring in central flow path 172 and therefore to the lower area of mandrel 150, operation of tool 100 is prevented because of the pressure equalization of control line 184. Specifically, annular flow path 174 and central flow path 172 are in fluid communication with one another above tool 100. The pressure in annular flow path 174 above sleeve 176 is communicated across mandrel assembly 150 via control line 184 that serves as a pathway to equalize pressure across mandrel assembly 150.

Figure 2E:
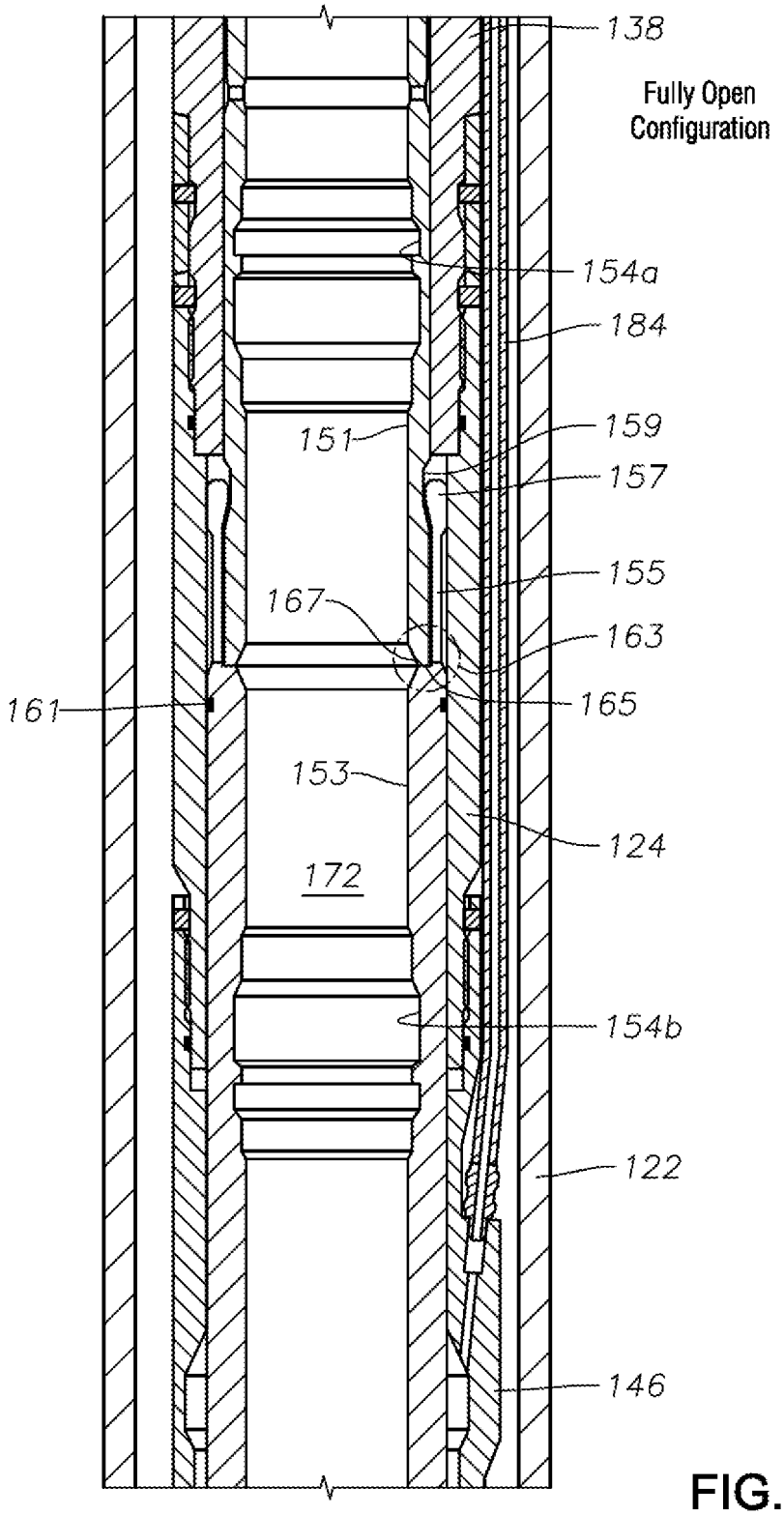

After treatment or other operations to the lower zone or zones are complete, the lower zones may be plugged off and a tubing string may be stabbed into polished bore receptacle 128 of inner tubular assembly 124. Here, for example, the lower zones may be plugged off by a ball valve installed in the tubing string below the tool; however, any kind of valve or plug installed below the tool that prevents fluid and pressure communication to the lower zones can be used. Nevertheless, in this configuration, annular flow path 174 and central flow path 172 are no longer in fluid communication with one another above tool 100. Now, increased pressure within central flow path 172 is communicated to the lower end of lower mandrel component 153, thus resulting in a push force being applied that forces lower mandrel component 153 up against upper mandrel component 151. As can be seen in FIG. 2E most clearly, upper mandrel component 151 slidingly engages the inner surface of lower mandrel component 153. Lower mandrel component 153 includes one or more collet fingers 155 extending therefrom having a collet head 157 thereon. Collet head(s) 157 rests within groove(s) 159 on the outer surface of upper mandrel component 151. A seal 161 seals between lower mandrel component 153 and inner tubular 124 to prevent fluid pressure from central flow path 172 from reaching collet finger(s) 155.

Therefore, as the push force is applied to the lower end of lower mandrel component 153, lower mandrel component 153 is urged up against upper mandrel component 151 at a push force transfer point 163. Push force transfer point 163 is the intersecting point of the upper and lower mandrel components 151,153. Push force transfer point 163 includes a shoulder 165 on lower mandrel component 153, and the end surface 167 of upper mandrel component 151. At push force transfer point 163, a push force may be transferred from lower mandrel component 153 to upper mandrel component 151 and vice versa.

As the push force continues to be applied to upper mandrel component 151, a predetermined force value is reached whereby the collet fingers of collet assembly 180 are radially retracted to pass through a downwardly facing shoulder 186 of housing assembly 102, and sleeve 176 and mandrel assembly 150 shift in the uphole direction to the positions depicted in FIG. 2E, whereby sleeve 176 is in the fully open position. Here, collet assembly 180 reengages with housing assembly 102 in annular recess 188. Sleeve 176 is in its upper position partially disposed within annular pocket 116 of housing assembly 102 with seals 178 engaging an outer sealing surface of housing extension 110. In this configuration, fluid communication between annular flow path 174 and the upper zone is allowed, enabling, for example, production from the upper zone into annular flow path 174. Importantly, in this configuration, seals 178 are protected from fluid flow or any abrasive materials therein as seals 178 are sealingly engaged with the outer sealing surface of housing extension 110 and out of the flow path. As such, seals 178 are not susceptible to damage during production from the upper zone or other fluid flow operations there through.

Figure 2F:
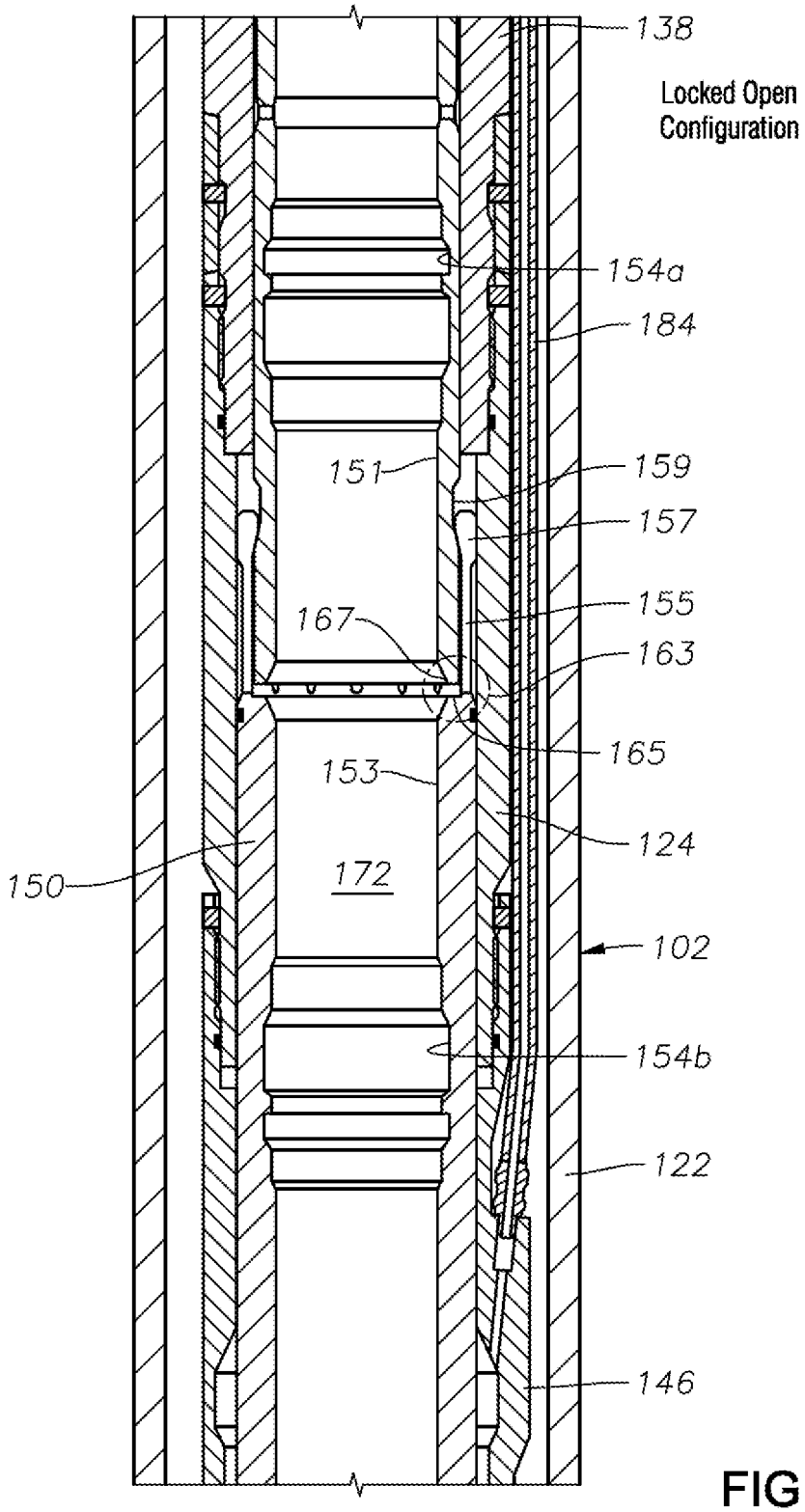

FIG. 2F shows mandrel assembly 150 in the lock open, or "locked out," position. As previously described, if there is a pressure differential between annular flow path 174 and central flow path 172 after opening of sleeve 176, a pull force may be applied to lower mandrel component 153. If a pull force is applied to lower mandrel component 153, collet head 157 of fingers 155 will be forced out from groove 159, where collect head 157 will become wedged between inner tubular 124 and upper mandrel component 151, thus applying a "brake" to further movement of mandrel assembly 150. Thus, in this embodiment, collet fingers 155 serve as the pull force lock mechanism. For example, when tool 100 is in the open position, if pressure in annular flow path 174 is greater than the pressure in central flow path 172, a resulting pull force is created which moves lower mandrel component 153 downwardly away from upper mandrel component 151. Once in the locked out position, sleeve 176 is prevented from undesired shifting between the open and closed positions. Moreover, in the locked out position, only a small fraction of the load is transferred to collet assembly 180, thus allowing much greater annulus pressures to be withstood without re-closing sleeve 176.

When it is desired to return tool 100 from the open position to the closed position in certain illustrative methods, a shifting tool (e.g., lock mandrel and plug) may be run downhole on a conveyance (e.g., wireline) and positioned within tool 100. The lock mandrel and plug is operable to engage either profile 154*a* of the upper mandrel component 151 or profile 154*b* of lower mandrel component 153. Once engaged, the shifting tool may be moved axially to apply the push force, also moving mandrel assembly 150, to reclose and/or reopen sleeve 176.

Figure 3A:
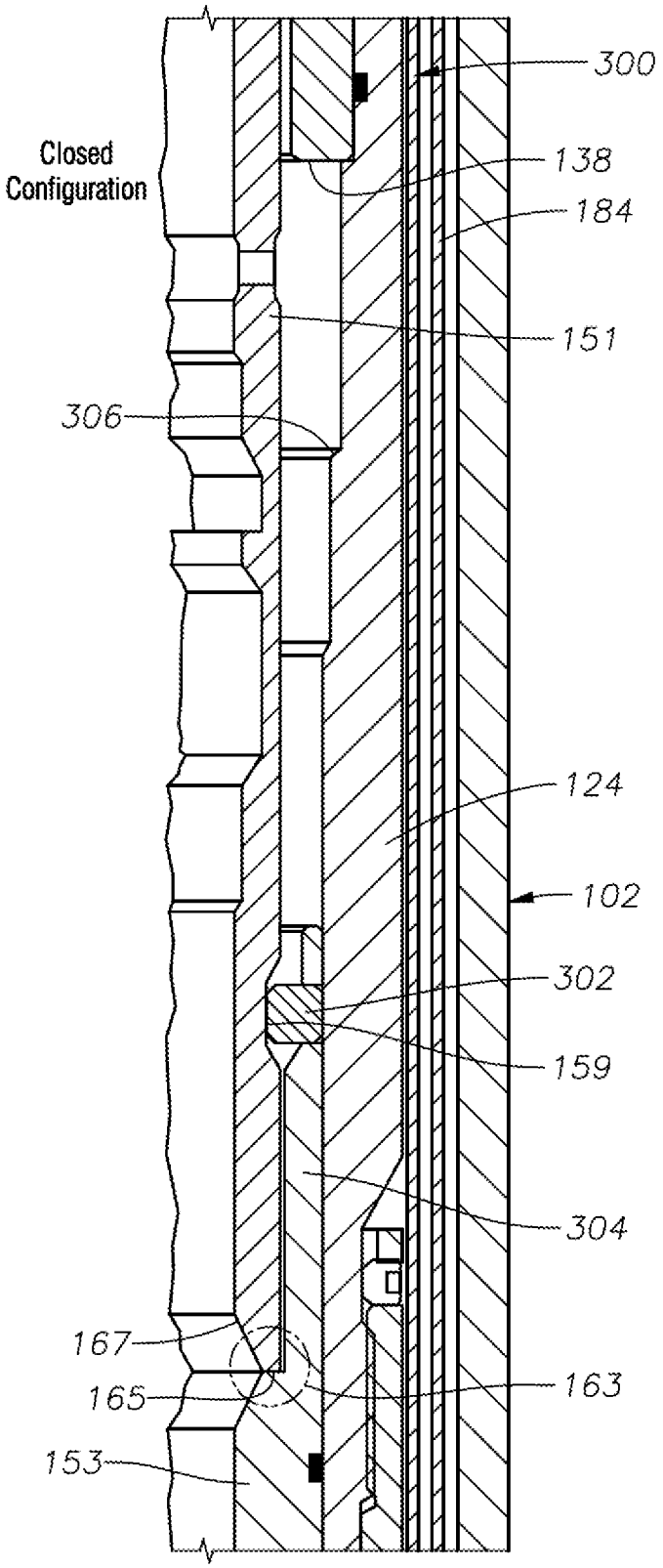
FIGS. 3A-3C are partial views of a multi-zone isolation tool using a lug extension, according to certain alternative embodiments of the present disclosure.
Figure 3B:
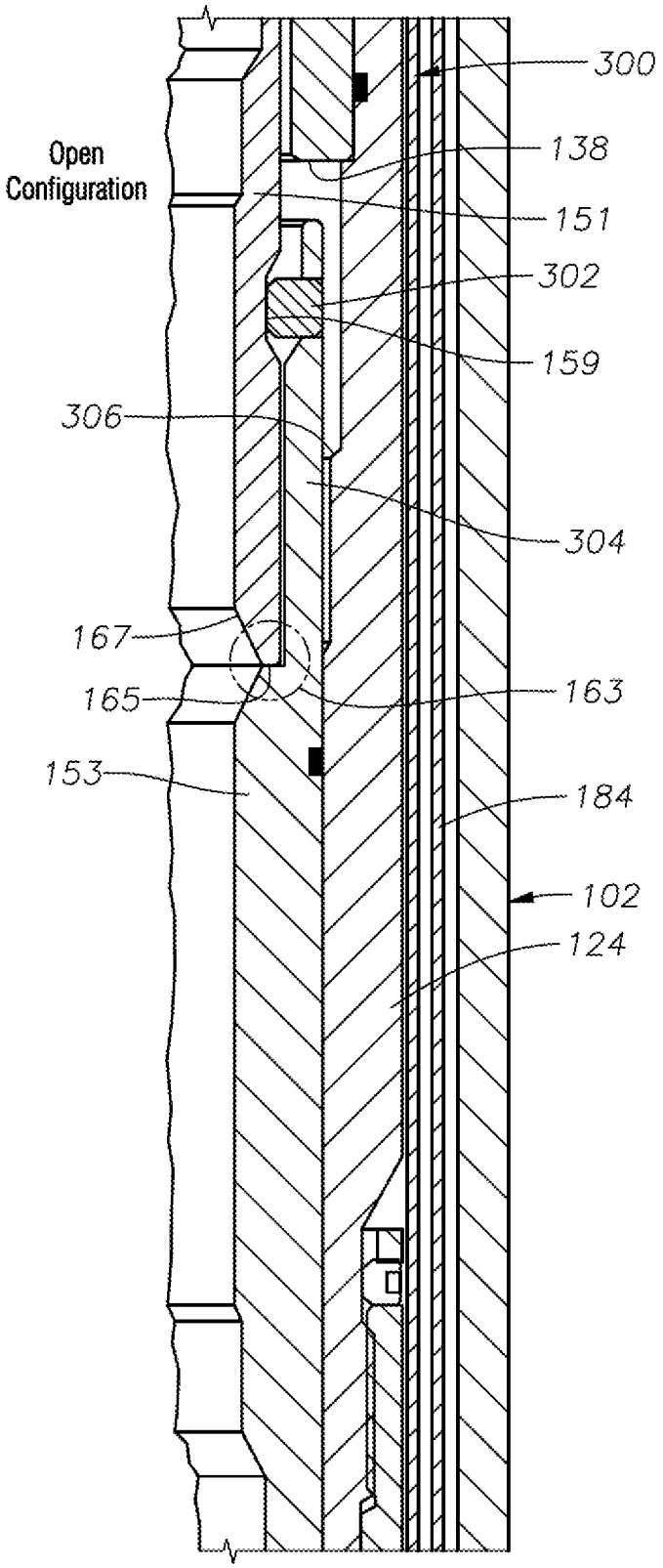
Figure 3C:
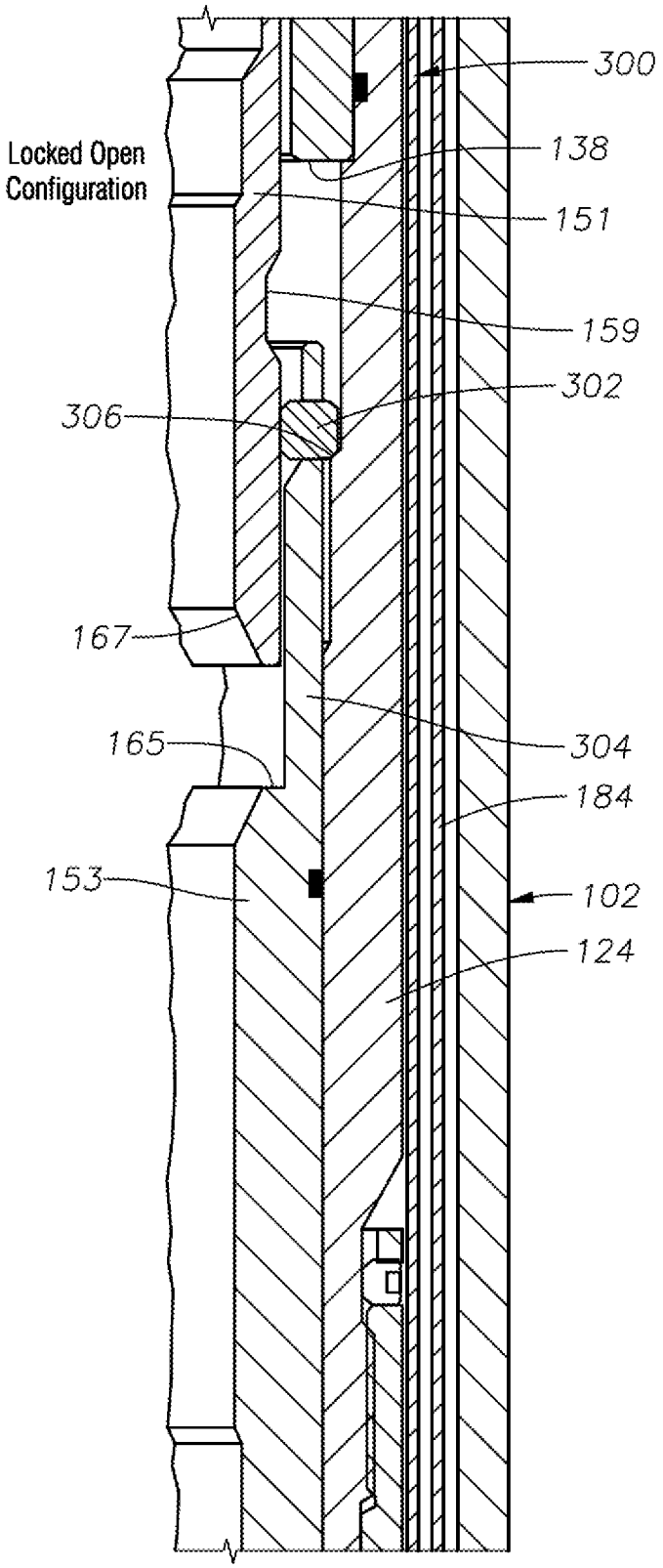

FIGS. 3A-3D are sectional partial views of tool 300, according to certain illustrative embodiments of the present disclosure. Tool 300 is similar to tool 100 previously described, using like numerals, and may therefore be understood with reference thereto. However, instead of collet fingers, multi-zone isolation tool 300 includes a lower mandrel component 153 having a lug extension 302 thereon which surrounds upper mandrel component 151. Here, an extended portion 304 includes a lug 302 that rests within groove 159 of upper mandrel component 151. FIG. 3A shows tool 300 in the closed configuration. To open tool 300 (FIG. 3B), the same push force is applied as described above in relation to tool 100. Here, again push force transfer point 163 includes a shoulder 165 on lower mandrel component 153, and the end surface 167 of upper mandrel component 151.

When a pull force is applied to lower mandrel components 151,153, lug 302 is forced out of groove 159 (FIG. 3C), whereby it becomes wedged between upper mandrel component 151 and inner tubular 124 at shoulder 306, thereby locking out mandrel assembly 150. Thus, in this example, lug 302 and extension 304 act as the pull force lock mechanism. A shifting tool as previously described may be used to actuate sleeve 176 back to the closed position.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the illustrative term "below" can encompass both an orientation of above and below. The apparatus may be otherwise oriented (rotated 90 degrees or at other orientations) and the spatially relative descriptors used herein may likewise be interpreted accordingly.

Embodiments of the present disclosure described herein further relate to any one or more of the following paragraphs:

1. An apparatus for isolating a first zone from a second zone in a subterranean wellbore, the apparatus comprising an outer tubular; an inner tubular positioned within the outer tubular, thereby forming an annular flow path there between that is in fluid communication with the first zone, wherein the inner tubular defines a central flow path therein that is in fluid communication with the second zone; a sleeve positioned in the annular flow path to control fluid flow there through, the sleeve being axially moveable relative to the outer and inner tubular between a closed position and an open position; and a mandrel assembly slidingly positioned within the inner tubular and coupled to the sleeve, the mandrel being operable to shift the sleeve between the open and closed position, the mandrel assembly comprising an upper mandrel component and a lower mandrel component slidingly engaging the upper mandrel component, wherein the lower mandrel component is operable to move the sleeve if a push force is applied to the lower mandrel component, but the mandrel assembly becomes locked out if a pull force is applied to the lower mandrel component.

2. An apparatus as defined in paragraph 1, wherein the upper mandrel component slidingly engages an inner surface of the lower mandrel component.

3. An apparatus as defined in paragraphs 1 or 2, wherein the upper mandrel component slidingly engages an inner surface of the lower mandrel component; the upper mandrel component comprises a groove on an outer surface of the upper mandrel component; and the lower mandrel component comprises a collet finger positioned between the inner tubular and the upper mandrel component, the collet finger having a collet head which mates within the groove.

4. An apparatus as defined in any of paragraphs 1-3, wherein the upper mandrel component slidingly engages an inner surface of the lower mandrel component; the upper mandrel component comprises a groove on an outer surface of the upper mandrel component; and the lower mandrel component comprises an extended portion positioned between the inner tubular and the upper mandrel component, the extended portion having a lug which mates within the groove.

5. An apparatus as defined in any of paragraphs 1-4, wherein the mandrel assembly further comprises a push force transfer point, the push force transfer point comprising a lower mandrel component shoulder; and an upper mandrel component end surface which mates with the shoulder.

6. An apparatus as defined in any of paragraphs 1-5, wherein the lower mandrel component comprises a collet assembly surrounding the upper mandrel component, the collet assembly being operable to lock the mandrel assembly in response to the pull force applied to the lower mandrel component.

7. An apparatus as defined in any of paragraphs 1-6, wherein the lower mandrel component comprises an extended portion having a lug thereon, the extended portion surrounding the upper mandrel component and operable to lock the mandrel assembly in response to the pull force applied to the lower mandrel component.

8. An apparatus as defined in any of paragraphs 1-7, further comprising a pull force lock mechanism forming part of the lower mandrel component.

9. An apparatus as defined in any of paragraphs 1-8, wherein the outer tubular comprises an extension that forms an annular pocket; and the sleeve comprises at least one seal on an inner surface thereof such that, in the closed position, the seal engages an outer surface of the inner tubular and, in the open position, the seal engages an outer surface of the extension of the outer tubular.

10. An apparatus as defined in any of paragraphs 1-9, further comprising a collet assembly coupled to the sleeve, the collect assembly selectively preventing shifting of the sleeve relative to the outer tubular when the sleeve is in the open and closed position.

11. An apparatus as defined in any of paragraphs 1-10, further comprising an equalization pathway positioned within the annular flow path to selectively prevent actuation of the sleeve between the open and closed positions.

12. A method for isolating a first zone from a second zone in a subterranean wellbore, the method comprising disposing a multi-zone isolation tool within the wellbore in a closed position, the tool having an inner tubular defining a central flow path and an outer tubular defining an annular flow path with the inner tubular, the annular flow path in fluid communication with the first zone, the central flow path in fluid communication with the second zone, wherein a mandrel assembly includes an upper mandrel component that slidingly engages a lower mandrel component; applying a push force to the upper or lower mandrel components; in response to the push force, shifting a sleeve coupled to the mandrel assembly between the closed position, whereby the annular flow path is blocked, to an open position whereby the annular flow path is opened; and locking out the mandrel assembly if a pull force is applied to the lower mandrel component.

13. A method as defined in paragraph 12, wherein locking out the mandrel assembly comprises applying the pull force to the lower mandrel component; and causing a collet finger of the lower mandrel component to wedge between the upper mandrel component and the inner tubular.

14. A method as defined in paragraphs 12 or 13, wherein locking out the mandrel assembly comprises applying the pull force to the lower mandrel component; and causing a lug extension of the lower mandrel component to wedge between the upper mandrel component and the inner tubular.

15. A method as defined in any of paragraphs 12-14, wherein locking out the mandrel assembly comprises applying the pull force to the lower mandrel component; and causing a pull force lock mechanism to activate.

16. A method as defined in any of paragraphs 12-15, wherein the activation comprises causing the pull force lock mechanism to wedge between the upper mandrel component and the inner tubular.

17. A method for isolating a first zone from a second zone in a subterranean wellbore, the method comprising disposing an apparatus into the wellbore and performing a downhole multi-zonal operation using the apparatus, wherein the apparatus is defined as in any of paragraphs 1-11.

Although various embodiments and methods have been shown and described, the present disclosure is not limited to such embodiments and methods and will be understood to include all modifications and variations as would be apparent to one skilled in the art. Therefore, it should be understood that this disclosure is not intended to be limited to the particular forms disclosed. Rather, the intention is to cover all modifications, equivalents and alternatives falling within the spirit and scope of the disclosure as defined by the appended claims.

What is claimed is:

1. An apparatus for isolating a first zone from a second zone in a subterranean wellbore, the apparatus comprising:

an outer tubular;

an inner tubular positioned within the outer tubular, thereby forming an annular flow path there between that is in fluid communication with the first zone, wherein the inner tubular defines a central flow path therein that is in fluid communication with the second zone;

a sleeve positioned in the annular flow path to control fluid flow there through, the sleeve being axially moveable relative to the outer and inner tubular between a closed position and an open position; and a mandrel assembly slidingly positioned within the inner tubular and coupled to the sleeve, the mandrel assembly being operable to shift the sleeve between the open and closed position, the mandrel assembly comprising an upper mandrel component and a lower mandrel component slidingly engaging the upper mandrel component, wherein the lower mandrel component is operable to move the sleeve if a push force is applied to the lower mandrel component, but the mandrel assembly becomes locked out if a pull force is applied to the lower mandrel component, wherein the lower mandrel component comprises a collet assembly surrounding the upper mandrel component, the collet assembly being operable to lock the mandrel assembly in response to the pull force applied to the lower mandrel component.

2. An apparatus as defined in claim 1, wherein the upper mandrel component slidingly engages an inner surface of the lower mandrel component.

3. An apparatus as defined in claim 1, wherein:

the upper mandrel component slidingly engages an inner surface of the lower mandrel component;

the upper mandrel component comprises a groove on an outer surface of the upper mandrel component; and the lower mandrel component comprises a collet finger positioned between the inner tubular and the upper mandrel component, the collet finger having a collet head which mates within the groove.

4. An apparatus as defined in claim 3, wherein the mandrel assembly further comprises a push force transfer point, the push force transfer point comprising:

a lower mandrel component shoulder; and an upper mandrel component end surface which mates with the shoulder.

5. An apparatus as defined in claim 1, wherein:

the upper mandrel component slidingly engages an inner surface of the lower mandrel component;

the upper mandrel component comprises a groove on an outer surface of the upper mandrel component; and the lower mandrel component comprises an extended portion positioned between the inner tubular and the upper mandrel component, the extended portion having a lug which mates within the groove.

6. An apparatus as defined in claim 1, further comprising a pull force lock mechanism forming part of the lower mandrel component.

7. An apparatus as defined in claim 1, wherein:

the outer tubular comprises an extension that forms an annular pocket; and the sleeve comprises at least one seal on an inner surface thereof such that, in the closed position, the seal engages an outer surface of the inner tubular and, in the open position, the seal engages an outer surface of the extension of the outer tubular.

8. An apparatus as defined in claim 1, wherein the collet assembly is coupled to the sleeve, the collet assembly selectively preventing shifting of the sleeve relative to the outer tubular when the sleeve is in the open and closed position.

9. An apparatus as defined in claim 1, further comprising an equalization pathway positioned within the annular flow path to selectively prevent actuation of the sleeve between the open and closed positions.

10. An apparatus for isolating a first zone from a second zone in a subterranean wellbore, the apparatus comprising:

an outer tubular;

an inner tubular positioned within the outer tubular, thereby forming an annular flow path there between that is in fluid communication with the first zone, wherein the inner tubular defines a central flow path therein that is in fluid communication with the second zone;

a sleeve positioned in the annular flow path to control fluid flow there through, the sleeve being axially moveable relative to the outer and inner tubular between a closed position and an open position; and a mandrel assembly slidingly positioned within the inner tubular and coupled to the sleeve, the mandrel assembly being operable to shift the sleeve between the open and closed position, the mandrel assembly comprising an upper mandrel component and a lower mandrel component slidingly engaging the upper mandrel component, wherein the lower mandrel component is operable to move the sleeve if a push force is applied to the lower mandrel component, but the mandrel assembly becomes locked out if a pull force is applied to the lower mandrel component, wherein the lower mandrel component comprises an extended portion having a lug thereon, the extended portion surrounding the upper mandrel component and operable to lock the mandrel assembly in response to the pull force applied to the lower mandrel component.

11. A method for isolating a first zone from a second zone in a subterranean wellbore, the method comprising:

disposing a multi-zone isolation tool within the wellbore in a closed position, the tool having an inner tubular defining a central flow path and an outer tubular defining an annular flow path with the inner tubular, the annular flow path in fluid communication with the first zone, the central flow path in fluid communication with the second zone, wherein a mandrel assembly includes an upper mandrel component that slidingly engages a lower mandrel component;

applying a push force to the upper or lower mandrel components;

in response to the push force, shifting a sleeve coupled to the mandrel assembly between the closed position, whereby the annular flow path is blocked, to an open position whereby the annular flow path is opened; and locking out the mandrel assembly if a pull force is applied to the lower mandrel component, wherein locking out the mandrel assembly comprises:

applying the pull force to the lower mandrel component; and causing a collet finger of the lower mandrel component to wedge between the upper mandrel component and the inner tubular.

12. A method as defined in claim 11, wherein locking out the mandrel assembly comprises:

applying the pull force to the lower mandrel component; and causing a lug extension of the lower mandrel component to wedge between the upper mandrel component and the inner tubular.

13. A method as defined in claim 11, wherein locking out the mandrel assembly comprises:

applying the pull force to the lower mandrel component; and causing a pull force lock mechanism to activate.

14. A method as defined in claim 13, wherein the activation comprises causing the pull force lock mechanism to wedge between the upper mandrel component and the inner tubular.

* * * * *